United States Patent [19]

Owens et al.

[11] 3,977,616

[45] Aug. 31, 1976

[54] YARN WINDING APPARATUS

[75] Inventors: Malcolm P. Owens; Edgar E. Barnes, both of Charlotte, N.C.

[73] Assignee: Fiber Industries, Inc., Charlotte, N.C.

[22] Filed: Sept. 17, 1974

[21] Appl. No.: 506,701

Related U.S. Application Data

[62] Division of Ser. No. 411,560, Oct. 31, 1973, abandoned.

[52] U.S. Cl. ..... 242/46.4; 242/18 DD; 242/41

[51] Int. Cl.[2] ..... B65H 75/30; B65H 79/00

[58] Field of Search ..... 242/46.4, 46.2, 46.3, 242/46.6, 72.1, 18 DD, 18 R

[56] References Cited

UNITED STATES PATENTS

| | | | |
|---|---|---|---|
| 3,462,092 | 8/1969 | Mullins | 242/46.4 |
| 3,494,565 | 2/1970 | Mullins | 242/46.4 |
| 3,495,781 | 2/1970 | Graf et al. | 242/46.4 |
| 3,517,891 | 6/1970 | Zeis et al. | 242/46.4 |
| 3,779,472 | 12/1973 | Boggs | 242/46.4 X |
| 3,841,574 | 10/1974 | Lenk et al. | 242/18 DD |

*Primary Examiner*—Stanley N. Gilreath

[57] ABSTRACT

An improved apparatus for winding yarn or thread onto a bobbin to form a yarn package is described which comprises a support assembly for maintaining uniform pressure between the drive roll and yarn package during winding so that a yarn package having greater uniformity is produced. The described apparatus further includes an improved take-up roll having a braking means cooperating with a yarn package or bobbin release means, whereby the yarn package cannot be released from the take-up roll until the take-up roll has ceased rotation. Also described is a doffing mechanism associated with the winder for doffing yarn packages from the take-up roll after they are released by the package release means.

4 Claims, 10 Drawing Figures

YARN WINDING APPARATUS

This application is a division of our co-pending application Ser. No. 411,560 filed Oct. 31, 1973, now abandoned.

BACKGROUND OF THE INVENTION

Textile yarn or thread winding apparatus is normally comprised of a freely rotatable take-up roll which supports a bobbin, often cylindrical, upon which yarn is to be wound; a drive roll which rides in frictional contact with the yarn on the bobbin during winding to cause rotation of the take-up roll; and a yarn traversing mechanism to direct the point of entry of the yarn onto the bobbin so that a package having yarn uniformly distributed across its transverse dimension is produced.

In prior art apparatus of this type, the pressure of the drive roll against the yarn tends to vary as the diameter of the yarn package increases. As a result, the structure of the package from the bobbin outwardly is non-uniform and the size of the package that can be suitably formed is limited. While winders have been proposed with assemblies to improve the uniformity of the drive roll pressure against the yarn, such assemblies have provided only a limited solution, and/or have been unduly expensive or difficult to construct or maintain.

Additionally, release of the yarn packages from the take-up roll after building of the packages has tended to be somewhat slow, thus limiting the production capabilities of the winder, and can be hazardous to the operator if the package is inadvertently released before the take-up roll has stopped rotation.

Finally, actual removal, or doffing, of one or more yarn packages from the take-up roll is a relatively slow manual operation, further limiting the production capabilities of the apparatus.

Specific objects of the present invention are to provide an improved winding apparatus for producing packages of yarn or thread which is substantially free of the aforesaid deficiencies.

SUMMARY OF THE INVENTION

In general, the winding apparatus of the present invention is comprised of a support means for maintaining a uniform pressure of the drive roll against the yarn package so that larger, more uniform packages may be produced at high speeds; an improved take-up roll assembly for automatically releasing one or more yarn packages carried thereon only after the take-up roll has ceased rotation; and doffing means for partially removing the yarn packages from the take-up roll after the chuck has ceased rotation so the yarn packages may be quickly removed by the operator or by automatic doffing machinery.

The general winder support assembly of the present invention preferably comprises a stationary take-up roll supporting frame carrying a take-up roll; a moveable drive roll supporting frame carrying a drive roll in parallel, generally vertical alignment with the take-up roll; and drive roll support means for exerting a uniform constant, generally vertical pressure on the drive roll.

More specifically, the winder support assembly comprises a generally vertical stationary frame; a freely rotatable take-up roll mounted horizontally on the stationary frame; a generally vertical, moveable drive roll supporting frame spaced from and generally parallel to the stationary frame; a drive roll mounted horizontally from the moveable frame, the axis of said drive roll being parallel to and generally vertically aligned with the bobbin carrying surface of the take-up roll; a traversing mechanism mounted on said moveable frame parallel to said drive roll; and a supporting means for maintaining a constant upward pressure against said moveable frame. A structure of this type, as opposed to prior art supporting structures, produces a constant pressure between the drive roll and the yarn package as the package size increases, since all pressures remain constant.

The take-up roll of the present winder is comprised of a stationary shaft, a chuck or bobbin securing means carried by and freely rotatable about the stationary shaft, a braking means supported on the shaft and associated with the chuck for stopping rotation of the chuck about the shaft, a bobbin or yarn package release means adapted to release bobbins or yarn packages carried upon the chuck, and control means preventing actuation of the bobbin release means until after the chuck cease rotation.

More specifically, the take-up roll of the present invention comprises a stationary, hollow, elongated shaft; a bobbin chuck journaled axially on said shaft and freely rotatable thereon, the chuck being comprised of a plurality of radially extendible bobbin securing members or fingers; a pneumatic braking means secured on the end of the stationary shaft and operable by fluid pressure received through the shaft, the braking means comprised of a braking surface carried by a fluid pressure diaphragm and extendible into contact with a braking surface carried on the chuck upon the introduction of fluid, e.g., air, into the diaphragm; a bobbin release means secured to the shaft and associated with the bobbin securing means, the bobbin release means including a fluid diaphragm; and a control valve preventing the flow of fluid from the diaphragm of the braking means to the diaphragm of the bobbin release means until the chuck has ceased rotation.

The doffing mechanism of the present invention comprises a yarn package contacting arm moveable along a path parallel to the axis of the take-up roll, drive means for moving the arm along said take-up roll, means for stopping the arm at a predetermined position along the roll and means for returning the arm to an initial position. Preferably, the doffing mechanism further includes a control means associated with the bobbin release means of the take-up roll to prevent activation of the doffing arm until the yarn package has been released by the chuck or bobbin securing mans.

More specifically, the doffing mechanism comprises a yarn package pushing arm having a package contacting surface positioned substantially about said bobbin chuck and transversely of the axis thereof, pneumatic drive means for moving the arm axially along said chuck from an initial position at the inboard end of said chuck, i.e., the end adjacent the supporting structure, to a predetermined doffing position along the axis of said chuck toward the outboard end, stop means for stopping the arm at the predetermined doffing position, return means for automatically returning the arm to the initial position from the doffing position, and control means associated with the chuck preventing actuation of the drive means until the chuck ceases rotation. In the winding of two adjacent yarn packages, as described in greater detail hereinafter, the doffing mechanism further comprises a stop means for stopping the arm at an intermediate position, whereby doffing of the two yarn packages may be effected separately.

A preferred embodiment of the present invention is illustrated in the accompanying drawings in which.

DETAILED DESCRIPTION OF THE PREFERRED EMBODIMENT

Figure 1:
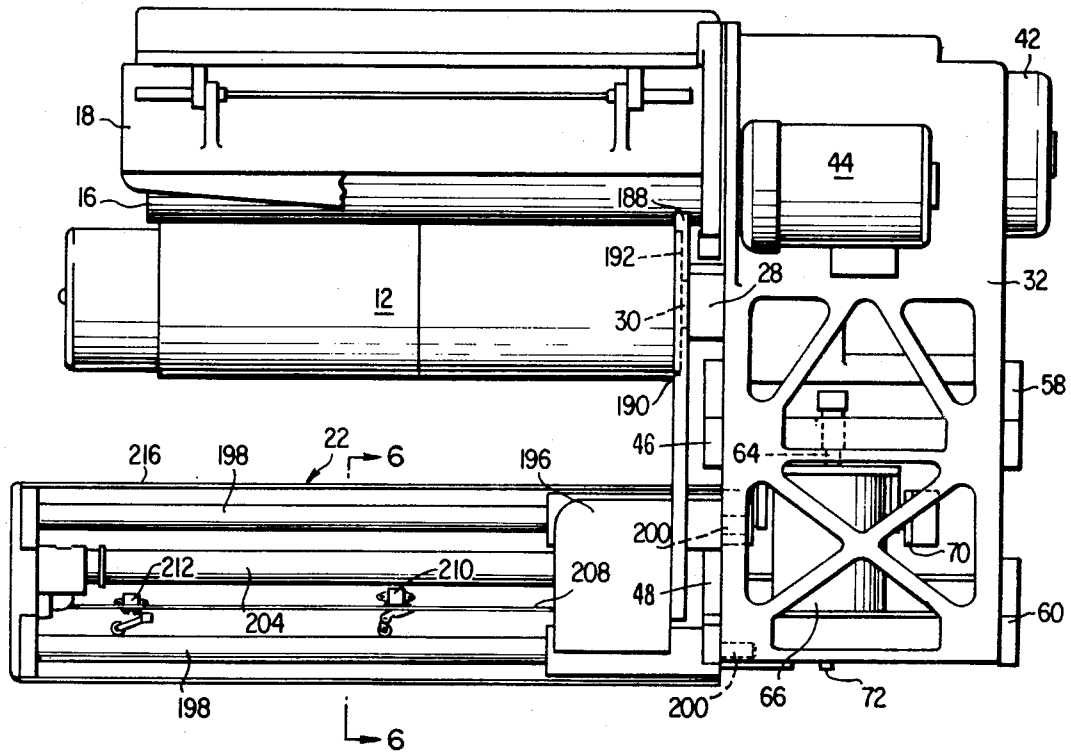
FIG. 1 is an end view of the winder apparatus illustrating the support assembly with the doffing mechanism.

The preferred embodiment illustrated in the drawings comprising a stationary take-up roll supporting frame, generally 10, carrying a take-up roll, generally 12, a vertically moveable drive roll supporting frame, generally 14, carrying a drive roll, generally 16, and a traversing mechanism, generally 18; pressure means, generally 20, for maintaining a constant upward pressure against frame 14 and drive roll 16; and a doffing mechanism, generally 22, to facilitate doffing of yarn packages from take-up roll 12. It is appreciated that the drive roll will be carried upward in a slight arc in the preferred embodiment. For purposes of the present description, however, such movement is considered to be vertical. To facilitate understanding of the invention, the winder support assembly, take-up roll, and doffing mechanism will be described under separate sub-headings. Operation of the winder will be described under an additional sub-heading.

Winder Support Assembly

Figure 2:
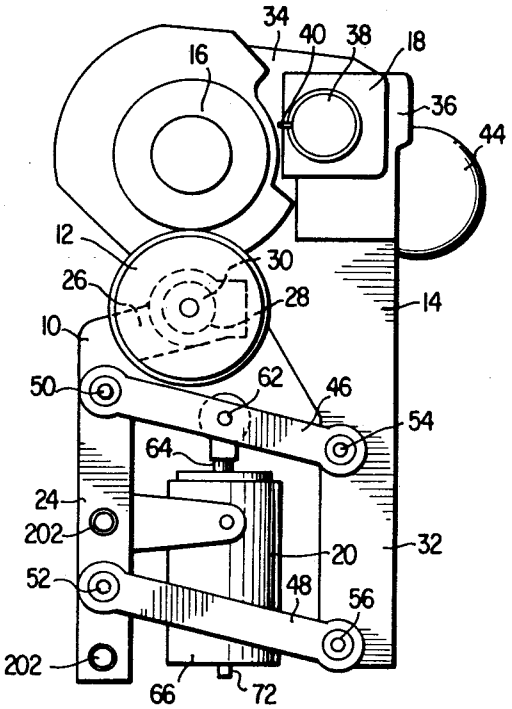
FIG. 2 is a frontal view of the apparatus with the doffing mechanism removed to facilitate illustration.

The winder support assembly, as illustrated in FIGS. 1 and 2 of the drawings, is comprised of a stationary vertical column 24 having an inwardly extending arm 26 integral with its upper end. A mounting member 28 integral with arm 26 is adapted to receive the stationary shaft 30 of horizontal take-up roll, generally 12.

A moveable vertical column 32 is positioned parallel to and spaced from column 24. An inwardly extending section 34 is integral with the upper end of column 32. Section 34 is adapted to suppport a drive roll, generally 16, in a horizontal position over take-up roll 12 so that the axes of rolls 12 and 16 are in a substantially vertical plane. Section 34 also supports a traversing mechanism, generally 18 comprised of a housing 36, a cam shaft 38, and a thread guide 40 in a horizontal position parallel to drive roll 16 to direct yarn about bobbins carried on take-up roll 12. Motors 42 and 44, also mounted on section 34 power drive roll 16 and traversing mechanism 18, respectively.

Stationary column 24 is connected to moveable column 32 on the side adjacent rolls 12 and 16 by a pair of parallel spaced arms 46 and 48 which are connected to column 24 with pins 50 and 52, respectively, and to column 32 with pins 54 and 56, respectively. Columns 24 and 32 are similarly supported at the opposite side by horizontal arms 58 and 60.

In order to effect substantially vertical movement of drive roll 16 relative to take-up roll 12, arm 46 is connected by pin 62 to upwardly extending plunger 64, extending from a pneumatic cylinder 66 which is secured to column 24 with mounts 68 and 70. Fluid, normally air, within cylinder 66 is maintained under constant pressure during winding, and thus exerts a constant upward pressure against roll 16, by connection of cylinder 66 at connector 72 with a constant pressure fluid supply, not shown. Accordingly, all pressure variation is eliminated since the constant downward pressure of column 32 and elements carried thereon is opposed by a constant upward pressure from cylinder 66.

Take-up Roll

Figure 3:
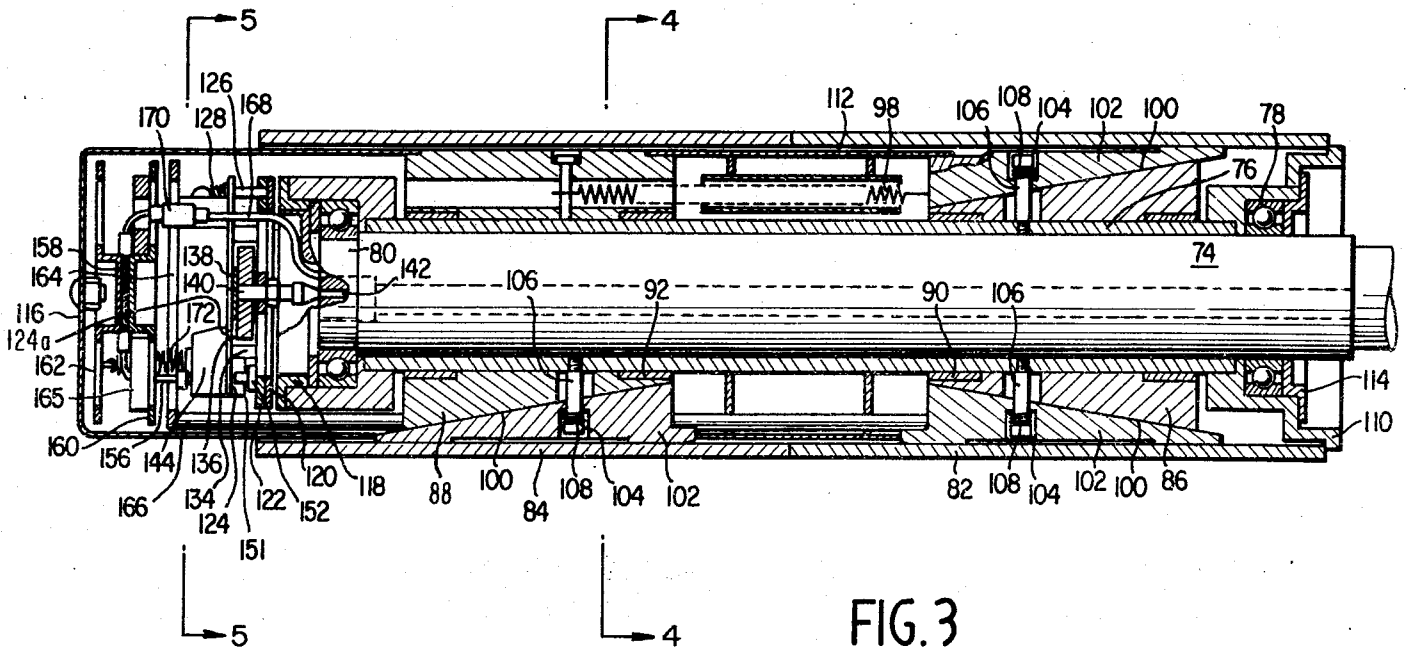
FIG. 3 is a sectional side view of the take-up roll.
Figure 4:
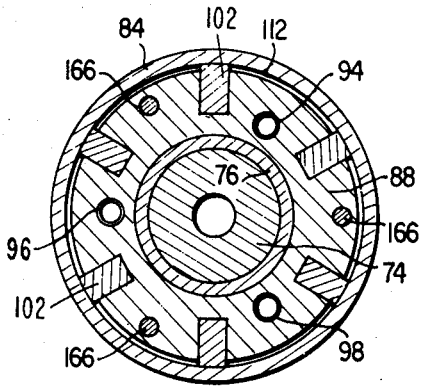
FIG. 4 is a cross-sectional view of the take-up roll along section 4—4 of FIG. 3.
Figure 5:
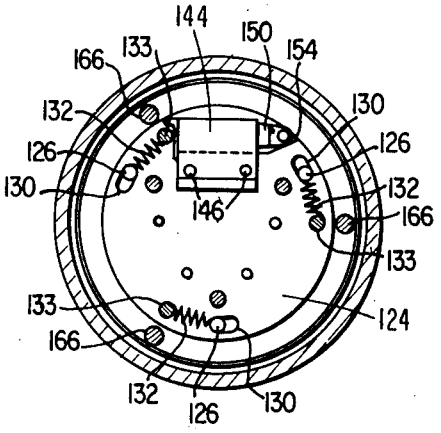
FIG. 5 is a cross-sectional view of the take-up roll along section 5—5 of FIG. 3.

Take-up roll 12, illustrated in detail in FIGS. 3, 4 and 5, is comprised of a hollow, cylindrical stationary shaft 74 having journaled thereon a sleeve 76 which is freely rotatable around shaft 74 on bearings 78 and 80.

In order to secure bobbins 82 and 84 in axial alignment on take-up roll 12, a chuck comprised of a pair of spaced expanders 86 and 88 are fitted about sleeve 76 and slidable on bushings 90 and 92. Expanders 86 and 88 are urged toward each other with expansion springs 94, 96 and 98, and have inwardly declining ramps 100 cut into their faces at a thirty degree spacing to receive fingers 102 which are secured through slots 104 in expanders 86 and 88 to sleeve 76 with bolts 106 carrying springs 108 to urge fingers 102 inwardly against ramps 100. Sleeve 76 is expanded at the inboard end to form shoulder 110 which acts as a stop for bobbins 82 and 84 fitted over take-up roll 12 during winding. A slotted cylindrical cover 112, secured to expander 88 an inner end cap 114 secured to sleeve 76 and an outer end cap 116 secured to expander 88 form the exterior covering of take-up roll 12.

In order to halt rotation of sleeve 76 and expanders 86 and 88 about shaft 74, the take-up roll 12 further includes a pair of brake shoes 118 and 120, shoe 118 being secured to sleeve 76 and rotatable therewith and shoe 120 being mounted upon the inner surface of non-rotatable end plate 122. Plate 122 is in turn mounted at a spaced distance from an axially aligned brake mounting plate 124 with slideable pins 126 carrying return springs 128 to urge plate 122 towards mounting plate 124. Pins 126 extend through circumferential slots 130 in plate 124 and are yielding restrained from circumferential movement by springs 132 secured to plate 124 for reasons to be hereinafter discussed by pins 133.

Plate 122 is spaced from plate 124 by a diaphragm backing plate 134 which encloses between plates 122 and 124 a diaphragm 136 serving to urge shoe 120 toward shoe 118, and a pneumatic piston 138 which communicates with a fluid pressure source, not shown, through fitting 140 and fluid line 142 extending through shaft 74.

A fluid control valve, generally 144, to be described in greater detail hereinafter, is mounted on the face of plate 124 opposite diaphragm 136 with mounting pins 146, with the interior of valve 144 communicating with the interior of diaphragm 136 through an aperture **124*a* in plate 124. Control valve 144 includes an actuating plunger 150 having a ported pin receiving arm 151 which is secured to a pin 152 connected to plate 122 and extending through a slot 154 in plate 124. Control valve 144 further includes a fluid exhaust line 156** extending outwardly therefrom.

In order to provide a means for releasing yarn packages form take-up roll 12, fluid line 156 extends from valve 144 into a second diaphragm 158 positioned between an inboard pusher plate 160 supported by mounting plate 165 and an outboard pusher plate 162 positioned in parallel alignment axially of shaft 74.

In order to release fingers 102 carried on inboard expander 86 from contact with bobbin 82, a release ring 164 is positioned parallel to inboard release plate 160 a slight distance from the surface of plate 160 opposite diaphragm 158 and is secured to expander 86 with push rods 166 which are secured to ring 164 and extend through the body of take-up roll 12.

Outboard pusher plate 162 is parallel to and spaced slightly from the interior face of end cap 116. Diaphragm 158 is vented through exhaust fluid line 168 which extends from diaphragm 158 through fitting 170 and outwardly through the interior of shaft 74 to join with the doffing mechanism hereinafter described. A return spring 172 urges pusher plate 162 inwardly toward pusher plate 160 against the pressure of diaphragam 158.

Figure 7:
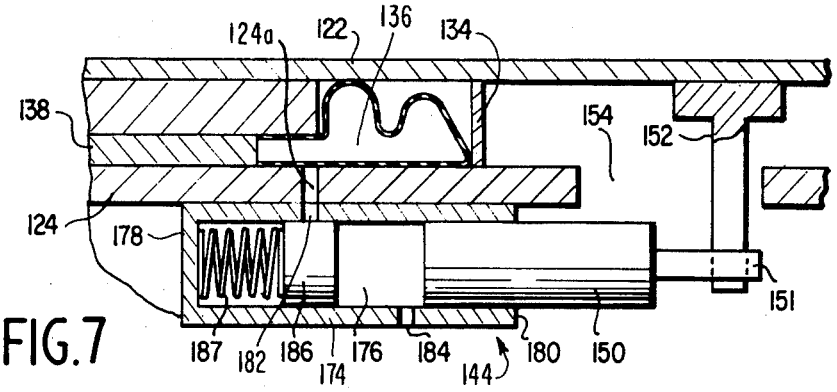
FIGS. 7–9 illustrate the interior of the control valve at various stages of operation.
Figure 8:
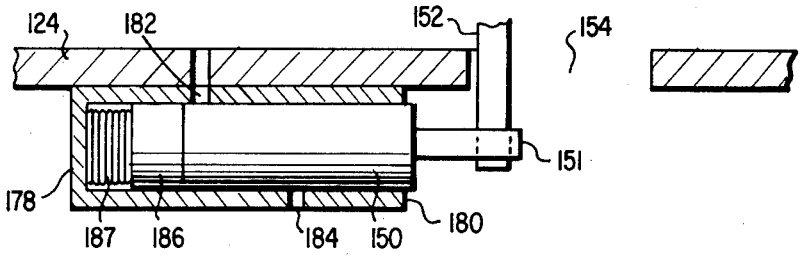
Figure 9:
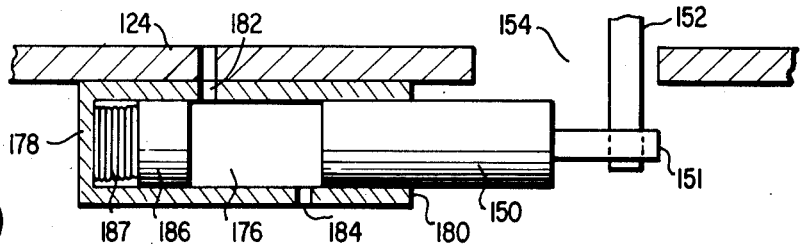

Fluid control valve 144, as illustrated in FIGS. 7–9, is comprised of a housing 174 having a bore 176 with a closed end 178 and an open end 180. An inlet port 182 and an outlet port 184 extend through housing 174 to communicate with bore 176. Aperture 124 *a* affords communication between interior of diaphragm 136 and inlet port 182. A plunger 150 having a ported arm 151 at its outer end extends through open end 180 and rides freely within bore 176 to uncover outlet port 184 when in its fully extended position as shown in FIG. 7 and to cover port 184 when in the inverted position shown in FIG. 8.

Valve 144 further comprises a piston 186 within bore 176 between end 178 and plunger 150. A spring 187 secured to end 178 urges piston 186 to an extended position toward plunger 150. When piston 186 is in the extended position illustrated in FIG. 7, it covers inlet port 182 and when in the retracted position illustrated in FIG. 9, uncovers port 182.

Doffing Mechanism

Figure 6:
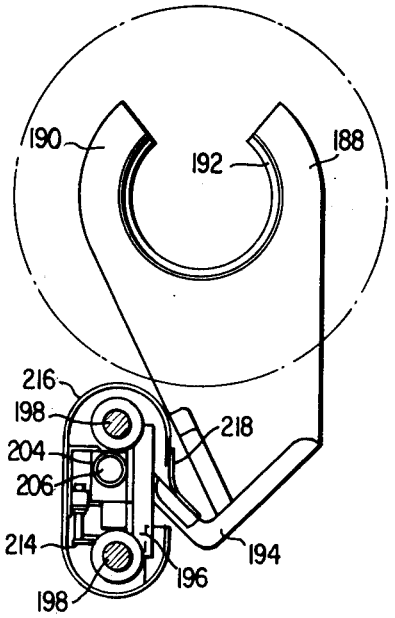
FIG. 6 is a cross-sectional view of the doffing mechanism along section 6—6 of FIG. 1.

The doffing mechanism, generally 22, illustrated in FIGS. 1 and 6, which is employed to rapidly remove yarn packages from the take-up roll and thus increase the production capabilities of the winder, is comprised of a pusher arm 188 having a yarn face 190 and a bobbin contacting face 192 cut into face 190 coaxial with take-up roll 12.

Pusher arm 188 is supported on a leg 194 as its lower end, leg 194 being secured to a carriage 196 which is mounted for travel parallel to take-up roll 12 on a pair of shafts 198 having threaded ends 200 enabling them to be secured to take-up roll supporting frame 10 in bolt holes 202. Movement of carriage 196 along shafts 198 is accomplished by the use of a pneumatic drive cylinder 204 of conventional construction. In a cylinder of this type a plunger 206 travels within cylinder 204 under pneumatic pressure. A cable 208 secured from plunger 206 to carriage 196 results in countermovement of the carriage.

In order to stop carriage 196 at desired locations along shafts 198 and thus doff outboard bobbin 82 and thereafter inboard bobbin 84 and automatically return carriage 196 and arm 188 to the inboard end of shafts 198 after doffing of bobbin 84, the mechanism is further provided with a pair of spaced limit valves 210 and 212 which are activated by an outwardly projecting pin 214 on carriage 196. Valve 210 is connected to a suitable fluid supply for controlling the flow of fluid to cylinder 204 to stop carriage 196 upon activation by contact with pin 214. Activation of valve 212 switched the flow of fluid to the inboard side of plunger 206 from the initial outboard side, reversing the direction of travel of carriage 196 to return it to its inboard position. The drive mechanism is enclosed within a housing 216 including a flexible cover 218.

As previously indicated, the doffing mechanism is preferably operably connected with the bobbin release mechanism of take-up roll 12 so that the doffing mechanism cannot be operated until the bobbins are released. This operable connection is accomplished by positioning a pneumatic blocking valve 219 in the fluid supply line to the pneumatic cylinder 204 of the doffing mechanism and connecting the pneumatic valve 218 to the exhaust line 168 extending from diaphragm 158 of the bobbin release mechanism. Pneumatic valve 219 is of the type that opens under pneumatic pressure to permit fluid to flow through the supply line from a pressurized fluid supply 220 to cylinder 204.

Figure 10:
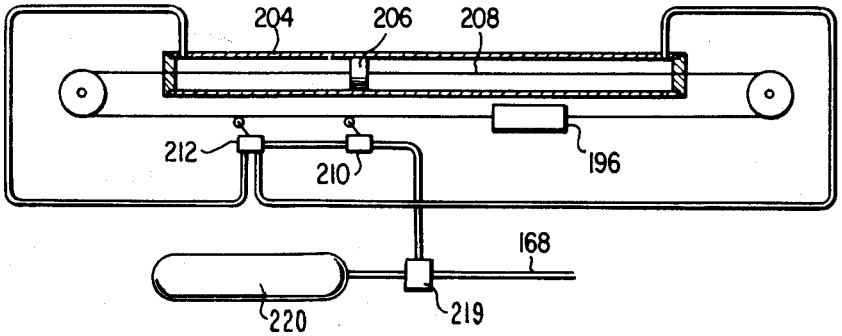
FIG. 10 is a schematic illustration of the control means for the doffing mechanism.

Referring to FIG. 10, the pneumatic lines work as follows: Assume that valve 212 is in condition to pass pressurized fluid to the outboard side of plunger 206. At the same time the valve 210 is closed so that no fluid can pass through the line from the source 220. Now the operator manually opens the valve 210 thereby permitting fluid to pass through valve 212 to the outboard side of the plunger 206 driving the plunger in the inboard direction and the carriage 196 in the outboard direction. When pin 214 contacts limit valve 210, the fluid line is closed and the motion of plunger 206 ceases. After removal of the outboard bobbin the operator again opens valve 210 manually whereupon fluid under pressure once again is admitted to the outboard side of plunger 206 driving the plunger to the inboard side until the pin 214 carried on carriage 196 reaches limit valve 212. The pin actuates limit valve 212 to direct pressure from the line entering the inboard side of plunger 206 to the line communicating to the outboard side of plunger 206. Accordingly, the plunger is now driven to the outboard end. Valves 210 and 212 thereafter may be reset to their initial positions either manually or by any suitable automatic means.

Operation

The operation of winding apparatus is best understood by initially considering the arrangement of the apparatus at the time when winding of two yarn packages is being completed. At this stage, drive roll 16 is rotating in contact with the yarn packages under a constant pressure provided by the weight of moveable structure 14, drive roll 16 and traversing mechanism 18 acting against the constant upward pressure of pressure means 20. Take-up roll 12 is rotating from frictional contact of drive roll 16 to convey yarn fron traversing mechanism 18 on to the yarn package.

During winding, fluid pressure is vented through fluid line 168 so that diaphragms 136 and 158 are contracted. Accordingly, brake shoe 120 is spaced from shoe 118 and pusher plates 160 and 162 are drawn together by spring 172. Fingers 102 are in a radially extended position, securing bobbins 82 and 84.

When the yarn packages attain the desired size, the operator clips the yarn, introduces additional air into cylinder 66 to raise drive roll 16 from contact with the yarn packages, and then introduces air under pressure from an appropriate supply source through line 142 to diaphragm 136.

When diaphragm 136 is pressurized, brake shoe 120 is expanded into contact with brake shoe 118 to stop rotation of take-up roll 12. Until braking, valve 144 is in the configuration shown in FIG. 7 in which inlet port 182 is covered by piston 186 forced to the extended position by spring 187 and outlet port 184 is uncovered by plunger 150 being held in its extended position by pin 152 carried on plate 122 and extending through slot 154 in plate 124.

Upon shoe 120 contacting shoe 118, previously stationary plate 122 is caused to rotate a small extent in a counterclockwise direction, as shown in FIG. 5, relative to plate 124 which remains stationary; rotation being permitted by pins 126 moving in circumferential slots 130 in plate 124 against the action of springs 132. At the same time, pin 152 travels in slot 154 to push plunger 150 into housing 174, forcing piston 186 against spring 187, as shown in FIG. 8. As a result, air is permitted to flow into bore 176 through uncovered inlet port 182 after retraction of plunger 150.

When take-up roll 12 ceases rotation, plate 122 rotates in a clock-wise direction to return to its initial position relative to plate 124 under the action of springs 132. With such rotation, plunger 150 is moved to the initial extended position by pin 152 and air pressure within bore 176, again uncovering outlet port 184. Piston 186 is retained in its retracted position, as shown in FIG. 9, by air pressure within bore 176. As a result, air is permitted to flow through valve 144 and outlet valve 184 to enter diaphragm 158 through fluid line 156.

Pressurizing of diaphragm 158 forces pusher plates 160 and 162 apart and against release ring 164 and end cap 116, respectively. Pressure of plate 160 against ring 164 moves ring 164 in an inboard direction pushing inboard push rods 166 secured to expander 86 and ring 164, and thus permitting fingers 102 to move radially inwardly on ramps 100 under the pressure of springs 108 and out of contact with bobbin 82. At the same time, pressure of pusher plate 162 against end cap 116, which is connected to expander 88, pulls expander 88 in an outboard direction, permitting fingers 102 to move radially inwardly on ramps 100 under the pressure of springs 108 to release outboard bobbin 84.

The operator then opens a fluid supply line to the outboard side of plunger 206 in cylinder 204 from fluid pressure supply 220 to move carriage 196 along shafts 198 in an outboard direction carrying the yarn packages on bobbins 82 and 84 against face 190 along take-up roll 12 until pin 214 contacts limit valve 210 to close the fluid line. Bobbin 84 then extends partially beyond take-up roll 12 permitting rapid removal by the operator or automatic doffing equipment. The operator then opens the fluid line again to pressurize cylinder 204 on the outboard side of plunger 206 and move carraige 196 further along shafts 198 until pin 214 contacts valve 212 to reverse fluid pressure to the inboard side of plunger 206 in cylinder 204 and return carriage 196 to the inboard position. Inboard bobbin 82 is then partly extended beyond take-up roll 12 for rapid removal. Opening of the fluid line from the fluid pressure supply 220 to cylinder 204 is permitted by the presence of pressure within line 168 holding open blocking valve 218.

The operator then places two new bobbins on take-up roll 12, releases the fluid pressure in diaphragms 136 and 158 to release the braking means and return fingers 102 to their radially expanded positions under the action of springs 94, 96 and 98 drawing together expanders 86 and 88. Drive roll 16 is then lowered by reducing air pressure in cylinder 66 to the desired constant winding pressure and yarn is threaded through thread guide 40 to be wound on the new bobbins.

It is to be understood that many modifications and variations may be made in the described apparatus without departing from the spirit and scope of the invention. For examples, the elements of the winder support apparatus may be rearranged so long as the desired constant pressure relationship is maintained Also, other control and drive means may be employed.

What is claimed is:

1. An improved bobbin supporting apparatus for use on a yarn winding machine comprising:

a. a stationary supporting shaft;

b. a bobbin securing means journaled to be freely rotatable on said shaft, said bobbin securing means comprising a plurality of ramps coupled to a plurality of fingers and spring means normally urging said fingers along the ramps to move radially outward to secure a bobbin;

c. a braking means engagable with said bobbin securing means for stopping rotation of said bobbin securing means about said shaft, said braking means including a braking surface engagable with said bobbin securing means and a first pneumatic diaphragm, said diaphragm causing engagement of said braking surface with the bobbin securing means;

d. a bobbin releasing means including a second pneumatic diaphragm and a connection to said fingers operative to move said fingers radially inward to a bobbin releasing position when said second diaphragm is expanded and to a bobbin grasping position when said diaphragm is relaxed; and e. control means preventing operation of said bobbin releasing means until said braking means has stopped rotation of said bobbin securing means.

2. An apparatus as claimed in claim 1, said control means comprising a valve opened to communicate between the diaphragms in response to the engagement of said braking means to permit the flow of fluid from said first diaphragm.

3. An apparatus as claimed in claim 2 said valve comprising a housing having a cylindrical bore, and inlet and outlet ports communicating with said bore through said housing; a piston within said bore; resilient means urging said piston over said inlet port; a plunger extending from said bore, said plunger having an inserted position covering said outlet port and pressing said piston against said resilient means to uncover said inlet port and an outer position uncovering said outlet port; and means responsive to the engagement of said braking means for moving said plunger to said inserted position and thereafter to said outer position upon braking of said bobbin securing means.

4. An apparatus as claimed in claim 2 the operative communication of said second pneumatic diaphragm to said fingers comprising rods connected between the second diaphragm and the fingers.

* * * * *